US012807194B2

(12) United States Patent
Schuller et al.

(10) Patent No.: US 12,807,194 B2
(45) Date of Patent: Nov. 24, 2026

(54) INSULATED AND REFRIGERATED RAILROAD CAR WITH VACUUM INSULATED SECTIONS

(71) Applicant: Gunderson LLC, Lake Oswego, OR (US)

(72) Inventors: Daniel J. Schuller, Hurst, TX (US); Ryan Pelton, Portland, OR (US); Peter L. Jones, Southlake, TX (US)

(73) Assignee: Gunderson LLC, Lake Oswego, OR (US)

( * ) Notice: Subject to any disclaimer, the term of this patent is extended or adjusted under 35 U.S.C. 154(b) by 129 days.

(21) Appl. No.: 19/008,761

(22) Filed: Jan. 3, 2025

(65) Prior Publication Data

US 2026/0192831 A1 Jul. 9, 2026

(51) Int. Cl.
*B61D 27/00* (2006.01)
*F25D 11/00* (2006.01)

(52) U.S. Cl.
CPC ..... *B61D 27/0027* (2013.01); *F25D 11/003* (2013.01); *F25D 2201/14* (2013.01)

(58) Field of Classification Search
CPC ..... B61D 27/0027; F25D 11/003; F25D 2201/14
See application file for complete search history.

(56) References Cited

U.S. PATENT DOCUMENTS 1,899,036 A * 2/1933 Hulse ..... F25D 11/003 62/434
2,619,803 A * 12/1952 Doering ..... B61D 27/0027 165/57
2,716,872 A * 9/1955 Test ..... F25D 3/10 220/592.01
2,881,600 A * 4/1959 Elfving ..... F25D 11/003 62/239
2,999,468 A * 9/1961 Crane ..... B61D 27/0027 414/800
4,448,041 A 5/1984 Southworth, Jr.
4,474,632 A 10/1984 Spees
4,800,733 A * 1/1989 Strobel ..... B65D 88/745 62/239
4,979,431 A * 12/1990 Fujimoto ..... F25D 21/08 454/91
5,316,171 A 5/1994 Danner et al.
5,869,407 A 2/1999 Rusek et al.
6,098,744 A 8/2000 Kawamura
6,758,057 B2 * 7/2004 Vince, II ..... F25D 16/00 62/332
9,174,656 B2 11/2015 Heitmeyer et al.
(Continued)

FOREIGN PATENT DOCUMENTS

CN 106585648 A 4/2017

OTHER PUBLICATIONS

Balalaev, et al., "Mass and Heat-Insulation Properties of the Bodies of Passenger and Insulated Railway Cards Made of Vacuum Honeycomb Panels", Journal of Applied Engineering Science, vol. 16, No. 1, pp. 50-59, 2018.

*Primary Examiner* — Emmanuel E Duke
(74) *Attorney, Agent, or Firm* — Neal, Gerber & Eisenberg LLP

(57) ABSTRACT

An insulated railroad car or insulated and refrigerated railroad car with one or more vacuum insulated sections wherein the vacuum insulated section(s) provide better insulation for the boxcar.

19 Claims, 8 Drawing Sheets

(56) References Cited

U.S. PATENT DOCUMENTS

| | | | | |
|---|---|---|---|---|
| 2004/0089194 | A1 | 5/2004 | Homes | |
| 2009/0107358 | A1 | 4/2009 | Becker et al. | |
| 2009/0126600 | A1 | 5/2009 | Zupancich et al. | |
| 2012/0009376 | A1 | 1/2012 | Rusek, Jr. | |
| 2015/0114254 | A1* | 4/2015 | Wadsworth | B61D 3/16 29/525.01 |
| 2015/0316309 | A1* | 11/2015 | Reitz | F25D 17/06 62/89 |
| 2017/0166382 | A1 | 6/2017 | Huang | |
| 2021/0345827 | A1 | 11/2021 | Zhang et al. | |
| 2022/0089198 | A1 | 3/2022 | Gachhadar et al. | |

* cited by examiner

INSULATED AND REFRIGERATED RAILROAD CAR WITH VACUUM INSULATED SECTIONS

BACKGROUND

The railroad industry employs a variety of different railroad cars for transporting different materials. Various known railroad cars that are configured to carry packaged materials are often called "box railroad cars" or simply "boxcars." Various known boxcars that are insulated or that are insulated and refrigerated can carry perishable packaged products are often called "insulated railroad cars," "insulated boxcars," "refrigerated railroad cars," or "refrigerated boxcars."

Various known insulated and refrigerated boxcars have certain insulated components that are configured to maintain the colder air inside the boxcar provided by the temperature of the product or by refrigeration units.

There is a continuing need to provide insulated and refrigerated boxcars that have better insulation properties to maintain the temperature of the product being transported and save energy consumed by the refrigeration units of the refrigerated boxcars.

SUMMARY

Various embodiments of the present disclosure provide a refrigerated railroad car that has one or more vacuum insulated sections that provide enhanced insulation properties for the refrigerated railroad car and that reduce the amount of energy needed to be consumed by the refrigeration unit of such refrigerated railroad car. The reduction in the amount of energy consumed by the refrigeration unit reduces the cost of operation of the refrigerated railroad car and also increases the lifespan of such refrigeration units. Various embodiments of the present disclosure provide vacuum insulated sections for refrigerated railroad cars. Various embodiments of the present disclosure relate to manufacturing a boxcar and specifically a refrigerated boxcar with one or more insulated sections.

Various embodiments of the present disclosure provide an insulated railroad car that has one or more vacuum insulated sections that provide enhanced insulation properties for the insulated railroad car and that increases the duration a temperature sensitive cargo can remain within the insulated railroad car during transit. Various embodiments of the present disclosure provide vacuum insulated sections for insulated railroad cars. Various embodiments of the present disclosure relate to manufacturing a boxcar and specifically an insulated boxcar with one or more insulated sections.

Other objects, features, and advantages of the present disclosure will be apparent from the following detailed disclosure, taken in conjunction with the accompanying sheets of drawings, wherein like reference numerals refer to like parts.

DETAILED DESCRIPTION

Figure 1:
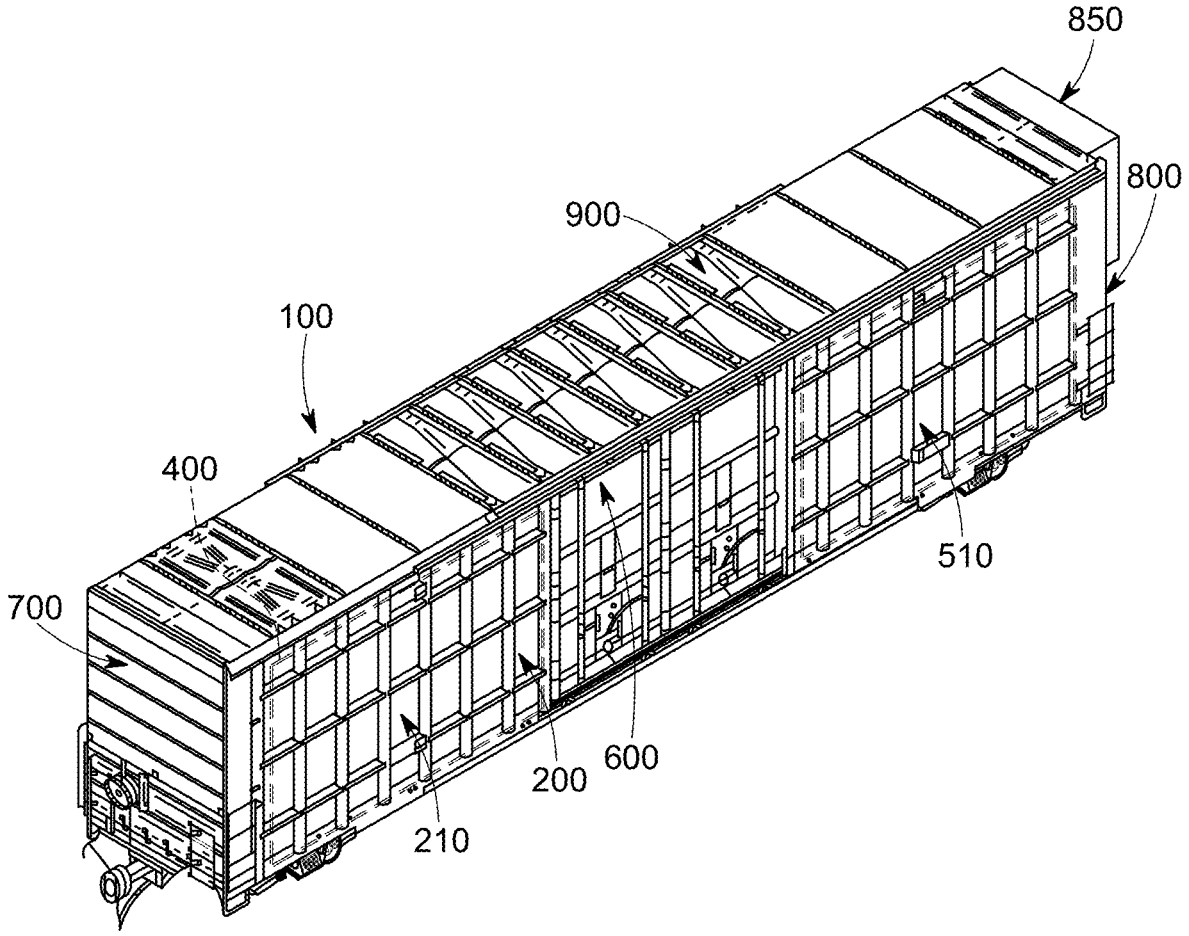
FIG. 1 is an isometric view of a refrigerated boxcar of one example embodiment of the present disclosure, shown with the doors on one side of the refrigerated boxcar in the respective closed positions, and shown with two sections of one of the side walls being insulated sections in accordance with one example embodiment of the present disclosure.
Figure 2:
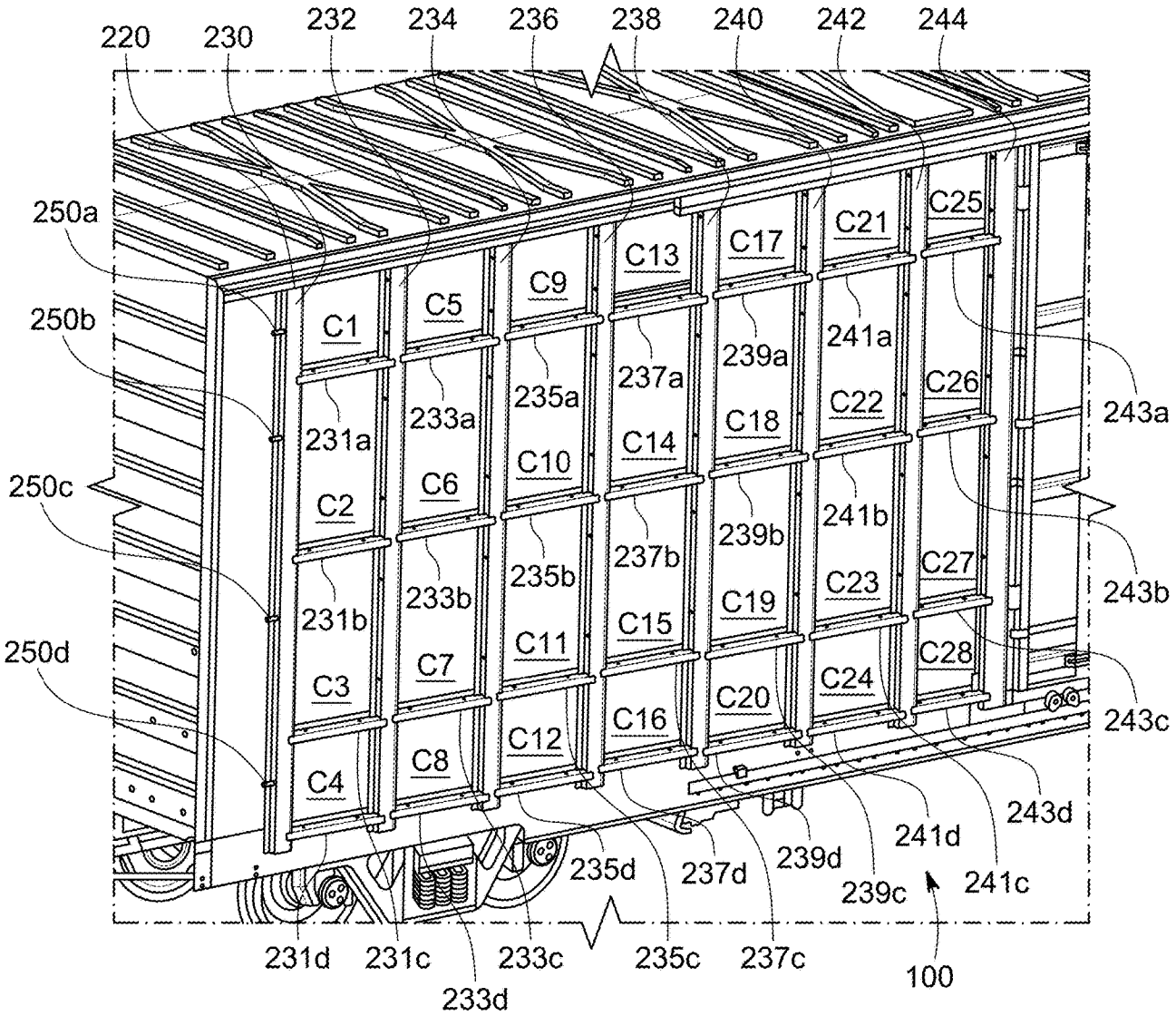
FIG. 2 is an enlarged fragmentary perspective view of part of the refrigerated boxcar of FIG. 1, showing part of the first insulated section of the refrigerated railroad car with the outer panel of the first insulated section removed.
Figure 3:
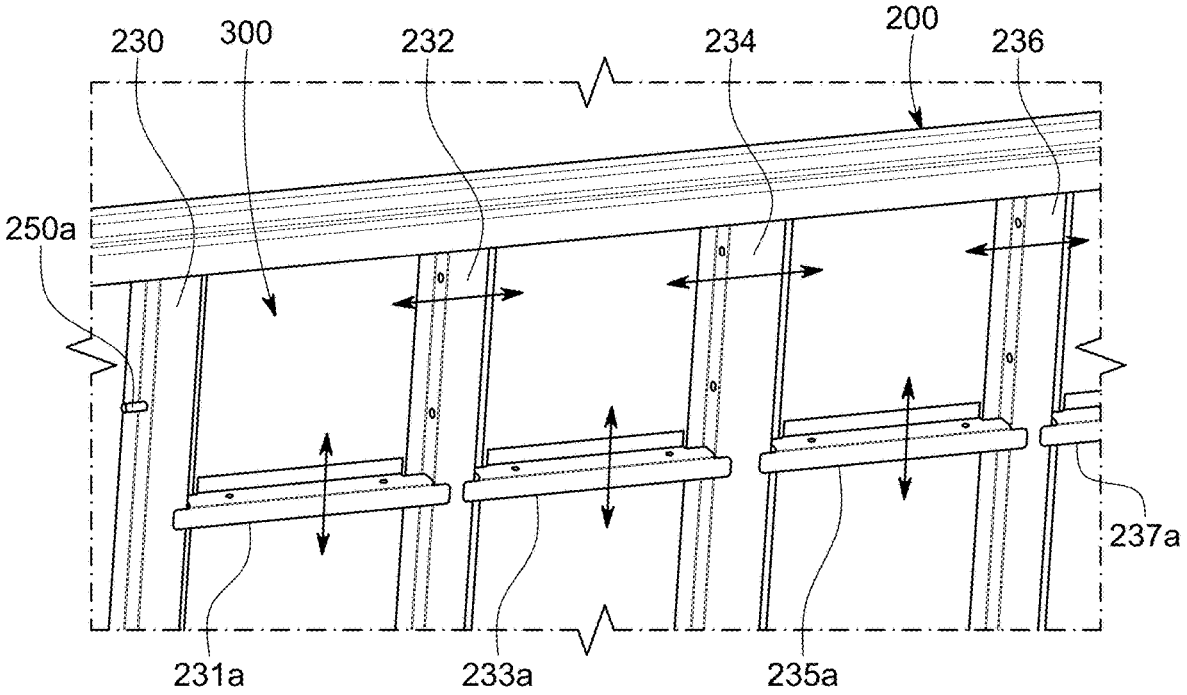
FIG. 3 is a further enlarged fragmentary perspective view of part of the refrigerated boxcar of FIG. 1, showing part of the first insulated section of the refrigerated railroad car with the outer panel of the first insulated section removed.
Figure 4:
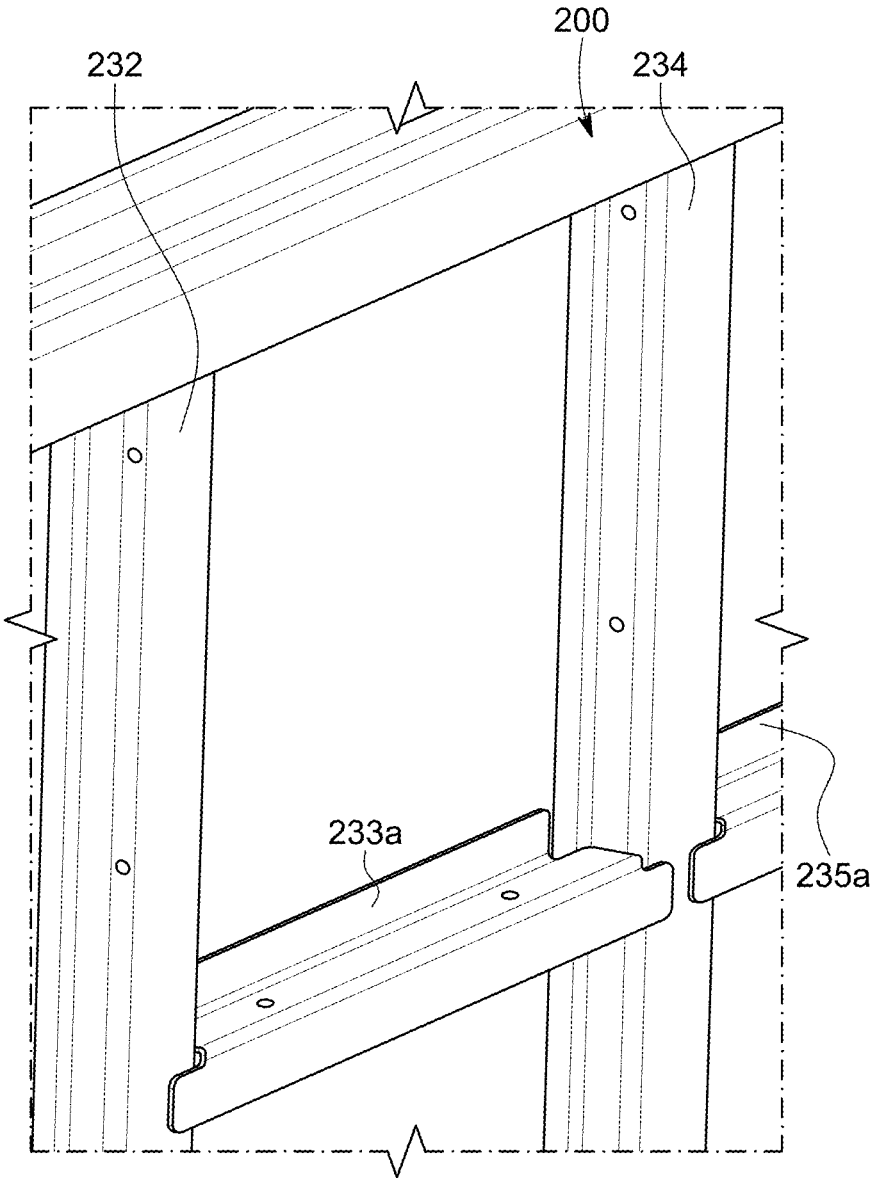
FIG. 4 is a further enlarged fragmentary perspective view of part of the refrigerated boxcar of FIG. 1, showing part of the first insulated section of the refrigerated railroad car with the outer panel of the first insulated section removed.
Figure 5:
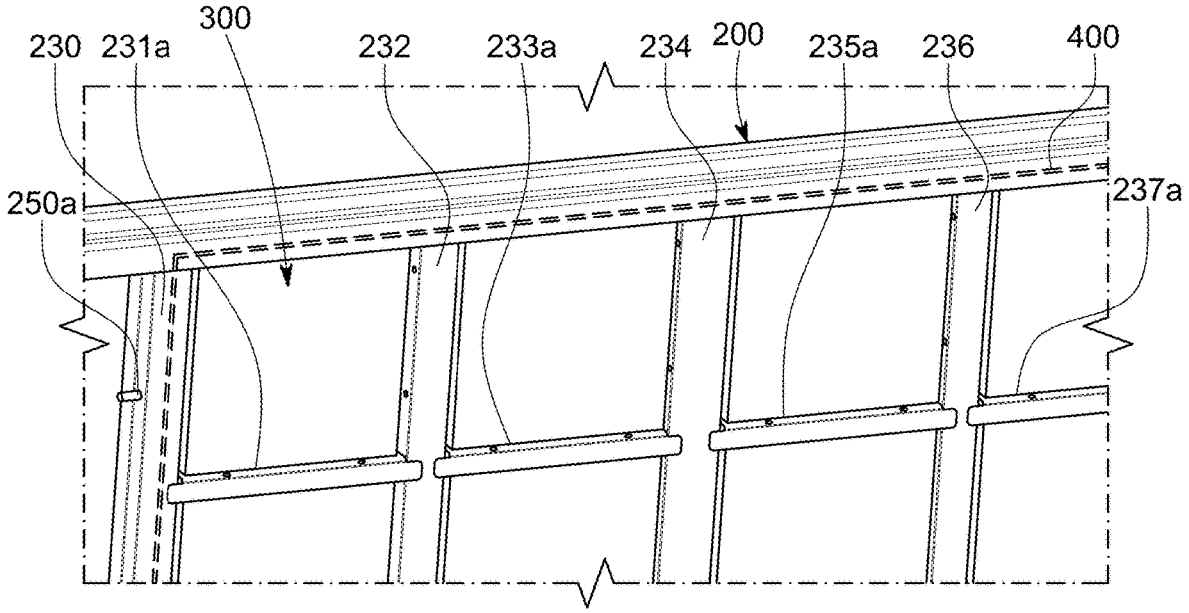
FIG. 5 is a further enlarged fragmentary perspective view of part of the refrigerated boxcar of FIG. 1, showing part of the first insulated section of the refrigerated railroad car with the outer panel of the first insulated section partially shown in phantom prior to attachment of that outer panel to certain of the structures that form the first insulated section.
Figure 6:
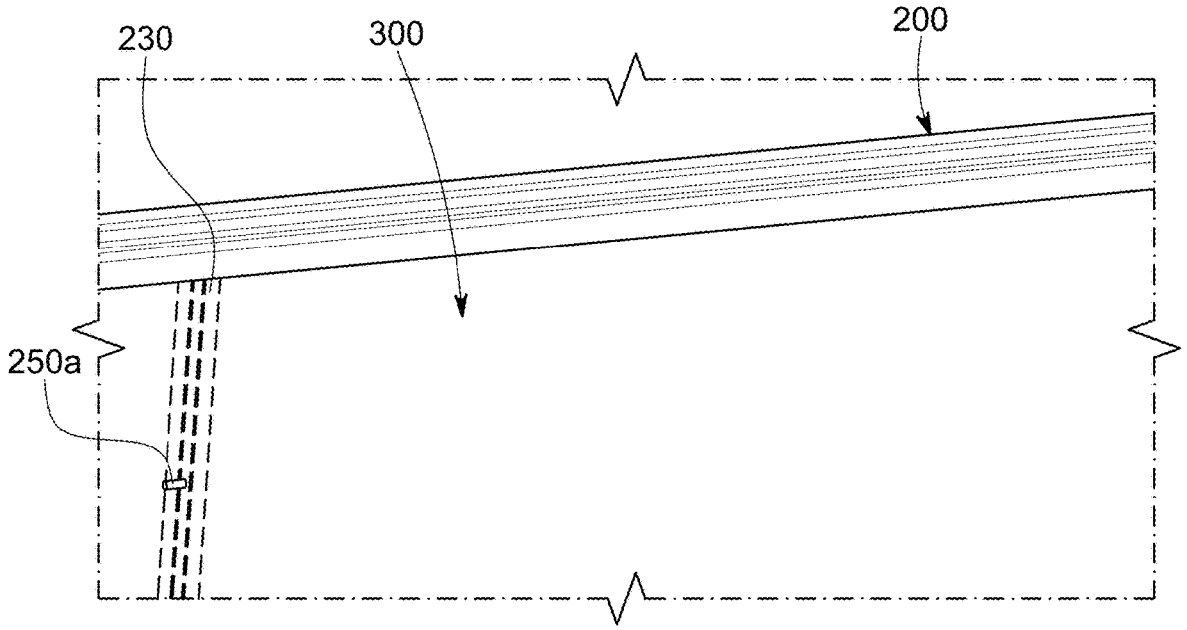
FIG. 6 is a further enlarged fragmentary perspective view of part of the refrigerated boxcar of FIG. 1, showing part of the first insulated section of the refrigerated railroad car with the outer panel of the first insulated section partially shown in solid and interior structures of the first insulated section shown in phantom.
Figure 7:
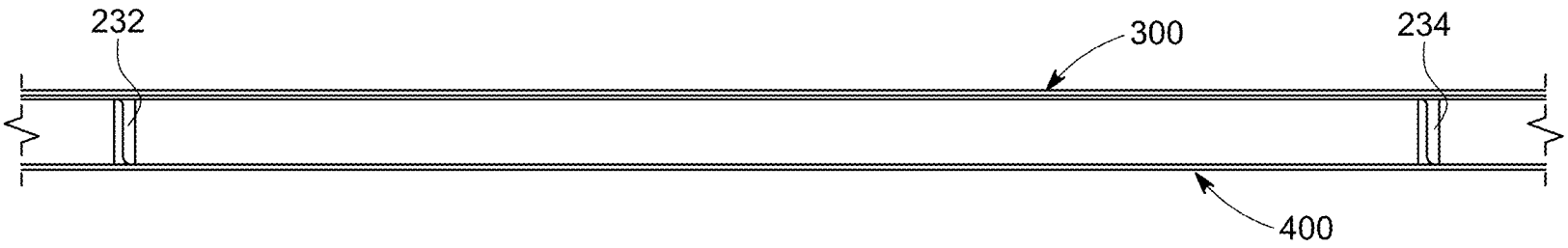
FIG. 7 is an enlarged fragmentary cross-sectional view of part of the first insulated section of part of the refrigerated boxcar of FIG. 1.

While the features, devices, and apparatus described herein may be embodied in various forms, the drawings show, and the specification describe certain exemplary and non-limiting embodiments. Not all of the components shown in the drawings and described in the specification may be required, and certain implementations may include additional, different, or fewer components. Variations in the arrangement and type of the components; the shapes, sizes, and materials of the components; and the manners of connections of the components may be made without departing from the spirit or scope of the claims. Unless otherwise indicated, any directions referred to in the specification reflect the orientations of the components shown in the corresponding drawings and do not limit the scope of the present disclosure. Further, terms that refer to mounting methods, such as coupled, mounted, connected, and the like, are not intended to be limited to direct mounting methods but should be interpreted broadly to include indirect and operably coupled, mounted, connected and like mounting methods. This specification is intended to be taken as a whole and interpreted in accordance with the principles of the present disclosure and as understood by one of ordinary skill in the art.

Various embodiments of the present disclosure provide a refrigerated railroad boxcar with one or more vacuum insulated sections. Various other embodiments of the present disclosure provide a vacuum insulated section for a refrigerated railroad boxcar. In various such embodiments, such vacuum insulated sections provide better insulation for the refrigerated boxcar. In various embodiments, each vacuum insulated section is independently vacuum sealed. In various embodiments, each vacuum insulated section includes two or more sub-sections that are each interconnected and vacuum sealed from a single point. Various embodiments of the present disclosure relate to manufacturing a boxcar and specifically a refrigerated boxcar with one or more insulated sections.

For purposes of description of the components of the illustrated example refrigerated boxcar described herein, the longitudinal direction is generally used to describe a direction of travel of or the length of the refrigerated boxcar, the transverse direction is generally used to describe a direction lateral or perpendicular to the direction of travel of the refrigerated boxcar, and the vertical direction is generally used to describe a direction perpendicular to the direction of travel of or the height of the refrigerated boxcar.

Figure 8:
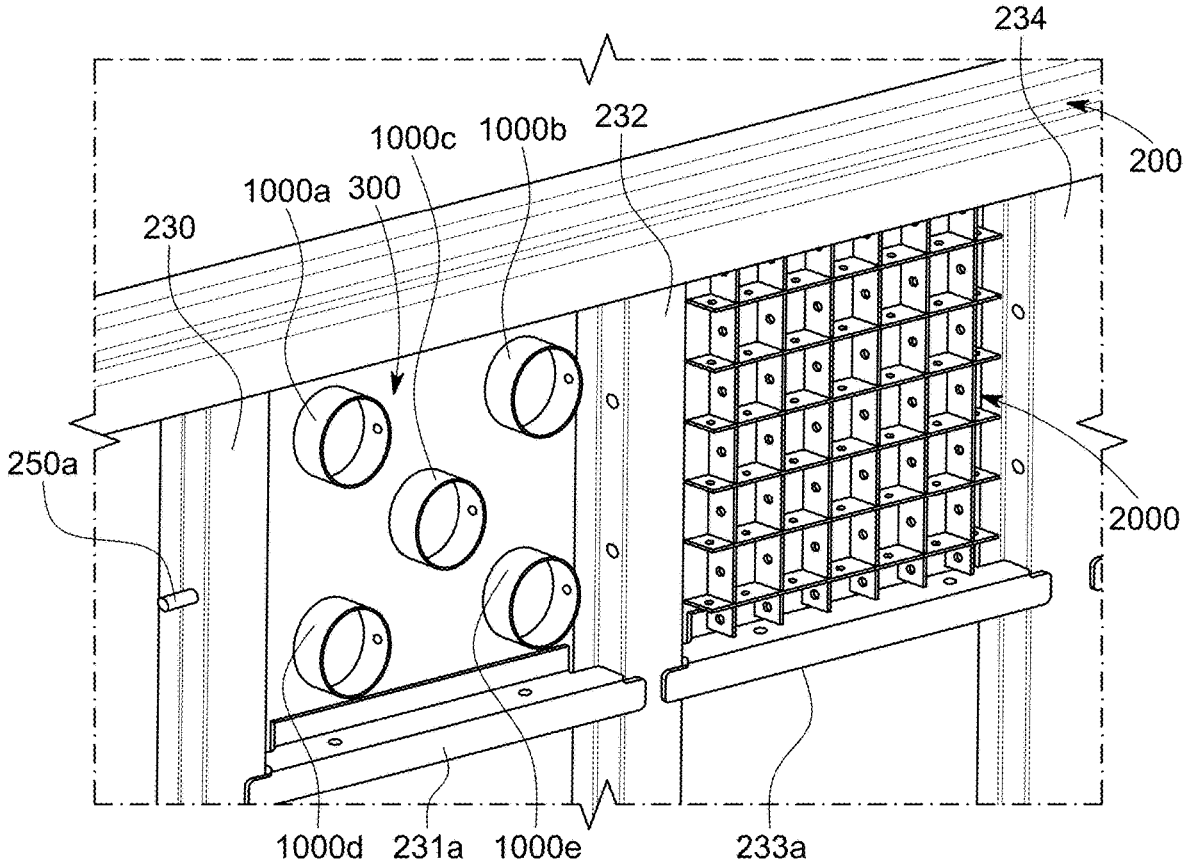
FIG. 8 is a fragmentary perspective view of part of the first insulated section of part of the refrigerated boxcar of FIG. 1, shown with different example internal panel anti-deflection members in accordance with the present disclosure.

Referring now to the drawings, FIGS. 1, 2, 3, 4, 5, 6, and 7 illustrate certain components of a boxcar and particularly a refrigerated boxcar 100 with vacuum insulated sections in accordance with one example embodiment of the present disclosure. FIG. 8 illustrates different example internal panel anti-deflection members for the vacuum insulated sections of the boxcar 100 in accordance with the present disclosure.

This refrigerated boxcar 100 includes: (1) a frame (not labeled); (2) spaced-apart trucks (not labeled) configured to support the frame; (3) a plurality of sets of wheel assemblies (not labeled) that respectively support the trucks; (4) a floor (not shown) connected to and supported by the frame; (5) a first side wall 200 connected to and extending upwardly from the floor and/or the frame; (6) a spaced-apart second side wall (not shown) connected to and extending upwardly from the floor and/or the frame; (7) a first end wall 700 connected to and extending upwardly from the floor and/or the frame; (8) a spaced-apart second end wall 800 connected to and extending upwardly from the floor and/or the frame; and (9) a roof 900 connected to the first side wall 200, the second side wall, the first end wall 700, and the second end wall 800 and supported by such members and the frame. The first side wall 200 includes a first door assembly 600. The second sidewall of the refrigerated boxcar 100 can additionally include a second door assembly (not shown) of the boxcar 100. Such a second door assembly can be identical to or different than the first door assembly. Additionally, except for the insulated sections of the refrigerated boxcar 100 described herein, the components of the refrigerated boxcar can be any suitable known boxcar components or any suitable future developed boxcar components and are thus not described herein for brevity. Additionally, the components, size, and configuration of the refrigerated boxcar can also vary in accordance with the present disclosure.

The refrigerated boxcar 100 includes one or more suitable refrigeration units such as refrigeration unit 850 mounted to the second end wall 800 of the railroad car 100. The refrigeration unit 850 can alternatively be mounted to the first end wall 700 of the railroad car 100. The refrigeration unit 850 is configured to refrigerate the inner package storage area (not shown) of the boxcar 100 defined by the floor, sidewalls, end walls, and roof of the boxcar 100.

In this illustrated example embodiment, the sidewall 200 includes two insulated sections 210 and 510 that are insulated in accordance with the present disclosure. It should be appreciated that the present disclosure contemplates that each of the second sidewall, the first and second end walls and the roof can also be formed from one or more insulated sections in accordance with the present disclosure. For brevity, these insulated components are not described here, but would be formed in a same or in a similar manner as described for the insulated section 210.

More specifically, the sidewall 200 includes a first insulated section 210, a second insulated section 510, and a door assembly 600 between the first insulated section 210 and the second insulated section 510. In this example embodiment, the first and second insulated sections 210 and 510 are mirror images of each of other. Thus, for brevity, insulated section 510 is not described in detail herein.

It should also be appreciated that the individual doors (not labeled) of the door assembly 600 can be insulated in a similar manner as described herein for section 210, or in another suitable manner.

The first insulated section 210 of the sidewall 200 includes a frame including a plurality of spaced-apart vertically extending supports 230, 232, 234, 236, 238, 240, 242, and 244. The vertically extending supports 230, 232, 234, 236, 238, 240, 242, and 244 are each connected to and extend from one or more of the floor, the frame, and the bottom side wall panel to the roof support 220 (or suitable members respectively connected thereto).

The first insulated section 210 of the sidewall 200 includes a plurality of spaced-apart horizontally extending braces 231*a*, 231*b*, 231*c*, 231*d*, 233*a*, 233*b*, 233*c*, 233*d*, 235*a*, 235*b*, 235*c*, 235*d*, 237*a*, 237*b*, 237*c*, 237*d*, 239*a*, 239*b*, 239*c*, 239*d*, 241*a*, 241*b*, 241*c*, 241*d*, 243*a*, 243*b*, 243*c*, and 243*d*. The braces 231*a*, 231*b*, 231*c*, and 231*d* are fixedly connected to and extend between the respective supports 230 and 232. The braces 233*a*, 233*b*, 233*c*, and 233*d* are fixedly connected to and extend between the respective supports 232 and 234. The braces 235*a*, 235*b*, 235*c*, and 235*d* are fixedly connected to and extend between the respective supports 234 and 236. The braces 237*a*, 237*b*, 237*c*, and 237*d* are fixedly connected to and extend between the respective supports 236 and 238. The braces 239*a*, 239*b*, 239*c*, and 239*d* are fixedly connected to and extend between the respective supports 238 and 240. The braces 241*a*, 241*b*, 241*c*, and 241*d* are fixedly connected to and extend between the respective supports 240 and 242. The braces 243*a*, 243*b*, 243*c*, and 243*d* are fixedly connected to and extend between the respective supports 242 and 244.

The supports and the braces are each made of steel, but can be made from other suitable materials. The supports and the braces are suitably connected via welding but can be connected in other suitable manners.

The insulated sidewall section 210 includes an inner panel 300 fixedly connected to the respective inner surfaces of the supports 230, 232, 234, 236, 238, 240, 242, and 244 and to the inner surfaces of the braces 231*a*, 231*b*, 231*c*, 231*d*, 233*a*, 233*b*, 233*c*, 233*d*, 235*a*, 235*b*, 235*c*, 235*d*, 237*a*, 237*b*, 237*c*, 237*d*, 239*a*, 239*b*, 239*c*, 239*d*, 241*a*, 241*b*, 241*c*, 241*d*, 243*a*, 243*b*, 243*c*, and 243*d*.

The inner panel is made of steel, but can be made from other suitable materials. The inner panel is suitably connected via welding to these supports and the braces, but can be connected in other suitable manners.

The insulated sidewall section 210 includes an outer panel 400 fixedly connected to the respective outer surfaces of the supports 230, 232, 234, 236, 238, 240, 242, and 244 and to the outer surfaces of the braces 231*a*, 231*b*, 231*c*, 231*d*, 233*a*, 233*b*, 233*c*, 233*d*, 235*a*, 235*b*, 235*c*, 235*d*, 237*a*, 237*b*, 237*c*, 237*d*, 239*a*, 239*b*, 239*c*, 239*d*, 241*a*, 241*b*, 241*c*, 241*d*, 243*a*, 243*b*, 243*c*, and 243*d*.

The outer panel is made of steel, but can be made from other suitable materials. The outer panel is suitably connected via welding to these supports and the braces, but can be connected in other suitable manners.

The inner panel 300 and the outer panel 400 are space-apart based on the respective widths of the supports and the braces.

It should be appreciated that one or more suitable air leakage prevention mechanisms such as caulking or gaskets can be employed to seal the panels to the braces and supports.

The insulated section 210 thus includes a series of individual air evacuation compartments C1 to C28 that are respectively formed by the roof support 220, the vertical supports 230, 232, 234, 236, 238, 240, 242, and 244, the horizontal braces 231*a*, 231*b*, 231*c*, 231*d*, 233*a*, 233*b*, 233*c*, 233*d*, 235*a*, 235*b*, 235*c*, 235*d*, 237*a*, 237*b*, 237*c*, 237*d*, 239*a*, 239*b*, 239*c*, 239*d*, 241*a*, 241*b*, 241*c*, 241*d*, 243*a*, 243*b*, 243*c*, and 243*d*, the inner panel 300, and the outer panel 400. Each compartment is of a defined length, height, and width.

Each air evacuation compartment C1 to C28 is sealed with respect to the respective members that define such compartment and is also configured such that air can flow out of such air evacuation compartment into another such compartment as further described below. In other words, the air evacuation compartments are configured such that air can flow from one or more adjacent air evacuation compartments into that air evacuation compartment and can be exhausted out of one or more check valves. The illustrated embodiment includes multiple check valves, but other embodiments can include a single check valve.

In the illustrated example embodiment, the first insulated section 210 includes four check valves 250*a*, 250*b*, 250*c*, and 250*d* connected to the vertically extending support 230. Each of the check values 250*a*, 250*b*, 250*c*, and 250*d* enables air to be directly removed from (and not flow back into) the air evacuation compartments C1, C2, C3, and C4, and thus air can be vacuumed out of or evacuated from such air evacuation compartments via the respective check valves. Each of the check values 250*a*, 250*b*, 250*c*, and 250*d* enables air to be indirectly removed from (and not flow back into) the air evacuation compartments C5 to C28 and thus air can be vacuumed out of or evacuated from such air evacuation compartments via the respective check valves. In other embodiments, only a single one of these check valves can be used to draw a vacuum in all of the evacuation compartments C1 to C28.

In this illustrated example embodiment, certain of the supports and certain of the braces each define one or more air channels extending through that support or that brace to fluidly connect the adjacent air evacuation compartments partially defined by such support or brace. It should be appreciated that the quantity of such air channels can vary, and can be one channel or more air channels in each such support or brace.

More specifically, in this example embodiment, the vertical support 230 defines four air channels (not shown or labeled) that are respectively in fluid communication with the air evacuation compartments C1, C2, C3, and C4 and check valves 250*a*, 250*b*, 250*c*, and 250*d*.

In this example embodiment, the vertical support 232 defines eight air channels (not labeled) that are in fluid communication with the compartments C1, C2, C3, C4, C5, C6, C7, and C8, and that fluidly connect compartment C1 to compartment C5, fluidly connect compartment C2 to compartment C6, fluidly connect compartment C3 to compartment C7, and fluidly connect compartment C4 to compartment C8.

In this example embodiment, the vertical support 234 defines eight air channels (not labeled) that are in fluid communication with the compartments C5, C6, C7, C8, C9, C10, C11, and C12 and that fluidly connect compartment C5 to compartment C9, fluidly connect compartment C6 to compartment C10, fluidly connect compartment C7 to compartment C11, and fluidly connect compartment C8 to compartment C12.

In this example embodiment, the vertical support 236 defines eight air channels (not labeled) that are in fluid communication with the compartments C9, C10, C11, C12, C13, C14, C15, and C16, and that fluidly connect compartment C9 to compartment C13, fluidly connect compartment C10 to compartment C14, fluidly connect compartment C11 to compartment C15, and fluidly connect compartment C2 to compartment C16.

In this example embodiment, the vertical support 238 defines eight air channels (not labeled) that are in fluid communication with the compartments C13, C14, C15, C16, C17, C18, C19, and C20 and that fluidly connect compartment C13 to compartment C17, fluidly connect compartment C14 to compartment C18, fluidly connect compartment C15 to compartment C19, and fluidly connect compartment C16 to compartment C20.

In this example embodiment, the vertical support 240 defines eight air channels (not labeled) that are in fluid communication with the compartments C17, C18, C19, C20, C21, C22, C23, and C24, and that fluidly connect compartment C17 to compartment C21, fluidly connect compartment C18 to compartment C22, fluidly connect compartment C19 to compartment C23, and fluidly connect compartment C20 to compartment C4.

In this example embodiment, the vertical support 242 defines eight air channels (not labeled) that are in fluid communication with the compartments C21, C22, C23, C24, C25, C26, C27, and C28, and that fluidly connect compartment C21 to compartment C25, fluidly connect compartment C22 to compartment C26, fluidly connect compartment C23 to compartment C27, and fluidly connect compartment C24 to compartment C28.

In this example embodiment, the last vertical support 244 does not define any air channels.

In this example embodiment, the brace 231*a* defines two air channels (not labeled) that are respectively in fluid communication with the compartments C1 and C2 and fluidly connect compartment C1 to compartment C2.

In this example embodiment, the brace 231*b* defines two air channels (not labeled) that are respectively in fluid communication with the compartments C2 and C3 and fluidly connect compartment C2 to compartment C3.

In this example embodiment, the brace 231*c* defines two air channels (not labeled) that are respectively in fluid communication with the compartments C3 and C4 and fluidly connect compartment C3 to compartment C4.

In this example embodiment, the brace 233*a* defines two air channels (not labeled) that are respectively in fluid communication with the compartments C5 and C5 and fluidly connect compartment C5 to compartment C6.

In this example embodiment, the brace 233*b* defines two air channels (not labeled) that are respectively in fluid communication with the compartments C6 and C7 and fluidly connect compartment C6 to compartment C7.

In this example embodiment, the brace 233*c* defines two air channels (not labeled) that are respectively in fluid communication with the compartments C7 and C8 and fluidly connect compartment C7 to compartment C8.

In this example embodiment, the brace 235*a* defines two air channels (not labeled) that are respectively in fluid communication with the compartments C9 and C10 and fluidly connect compartment C9 to compartment C10.

In this example embodiment, the brace 235*b* defines two air channels (not labeled) that are respectively in fluid communication with the compartments C10 and C11 and fluidly connect compartment C10 to compartment C11.

In this example embodiment, the brace 235*c* defines two air channels (not labeled) that are respectively in fluid communication with the compartments C11 and C12 and fluidly connect compartment C11 to compartment C12.

In this example embodiment, the brace 237*a* defines two air channels (not labeled) that are respectively in fluid communication with the compartments C13 and C14 and fluidly connect compartment C13 to compartment C14.

In this example embodiment, the brace 237*b* defines two air channels (not labeled) that are respectively in fluid communication with the compartments C14 and C15 and fluidly connect compartment C14 to compartment C15.

In this example embodiment, the brace 237*c* defines two air channels (not labeled) that are respectively in fluid communication with the compartments C15 and C16 and fluidly connect compartment C15 to compartment C16.

In this example embodiment, the brace 237*a* defines two air channels (not labeled) that are respectively in fluid communication with the compartments C13 and C14 and fluidly connect compartment C13 to compartment C14.

In this example embodiment, the brace 237*b* defines two air channels (not labeled) that are respectively in fluid communication with the compartments C14 and C15 and fluidly connect compartment C14 to compartment C15.

In this example embodiment, the brace 237*c* defines two air channels (not labeled) that are respectively in fluid communication with the compartments C15 and C16 and fluidly connect compartment C15 to compartment C16.

In this example embodiment, the brace 239*a* defines two air channels (not labeled) that are respectively in fluid communication with the compartments C17 and C18 and fluidly connect compartment C17 to compartment C18.

In this example embodiment, the brace 239*b* defines two air channels (not labeled) that are respectively in fluid communication with the compartments C18 and C19 and fluidly connect compartment C18 to compartment C19.

In this example embodiment, the brace 239*c* defines two air channels (not labeled) that are respectively in fluid communication with the compartments C19 and C20 and fluidly connect compartment C19 to compartment C20.

In this example embodiment, the brace 241*a* defines two air channels (not labeled) that are respectively in fluid communication with the compartments C21 and C22 and fluidly connect compartment C21 to compartment C22.

In this example embodiment, the brace 241*b* defines two air channels (not labeled) that are respectively in fluid communication with the compartments C22 and C23 and fluidly connect compartment C22 to compartment C23.

In this example embodiment, the brace 241*c* defines two air channels (not labeled) that are respectively in fluid communication with the compartments C23 and C24 and fluidly connect compartment C23 to compartment C24.

In this example embodiment, the brace 243*a* defines two air channels (not labeled) that are respectively in fluid communication with the compartments C25 and C26 and fluidly connect compartment C25 to compartment C26.

In this example embodiment, the brace 243*b* defines two air channels (not labeled) that are respectively in fluid communication with the compartments C26 and C27 and fluidly connect compartment C26 to compartment C27.

In this example embodiment, the brace 243*c* defines two air channels (not labeled) that are respectively in fluid communication with the compartments C27 and C28 and fluidly connect compartment C27 to compartment C28.

In this example embodiment, the bottom most braces 231*d*, 233*d*, 235*d*, 237*d*, 239*d*, 241*d*, and 243*d* each do not define any air channels.

In this illustrated example embodiment, certain of the braces each define two vertically extending air channels that extend through that brace to fluidly connect the adjacent compartments. It should be appreciated that the quantity of such air channels can vary and can be one air channel or more than two air channels in accordance with the present disclosure.

It should be appreciated that each of the compartments C1 to C28 are in fluid communication in this illustrated example embodiment.

In alternative embodiments, none of the braces have any air channels and do not fluidly connect any vertically adjacent compartments. In such alternative embodiments, (1) compartments C1, C5, C9, C13, C17, C21, and C25 would be fluidly connected but would not be fluidly connected to any of the other compartment; (2) compartments C2, C6, C10, C14, C18, C22, and C26 would be fluidly connected but would not be fluidly connected to any of the other compartments; (3) compartments C3, C7, C11, C15, C19, C23, and C27 would be fluidly connected but would not be fluidly connected to any of the other compartments; and (4) compartments C4, C8, C12, C16, C20, C24, and C28 would be fluidly connected but would not be fluidly connected to any of the other compartments. Thus, in such embodiments, the insulated section 210 would have multiple and specifically four separated sub-sections.

In other alternative embodiments, certain of the braces would not have air channels that connect certain compartments. For example, braces 231*b*, 233*b*, 235*b*, 237*b*, 239*b*, 241*b*, and 243*b* would not have air channels, and thus the insulated section 210 would have two separated sub-sections.

In various embodiments, the insulated section can include one or more suitable panel anti-deflection members in one or more or each of the air evacuation compartments. The anti-deflection members prevent or limit the amount of inward flexing of the inner and outer panels 300 and 400 when the air is withdrawn from the air evacuation compartments.

FIG. 8 illustrates first example panel anti-deflection members and a different second example panel anti-deflection members in accordance with the present disclosure.

The first example panel anti-deflection members 1000*a*, 1000*b*, 1000*c*, 1000*d*, and 1000*e* are each cylindrical members that are positioned between inner panel 300 and outer panel 400. Each of the cylindrical members define one or more air channels (not labeled) and are suitably attached to one of the panels (here panel 300). These panel anti-deflection members are equal to or slightly smaller in width than the width of the space between the panels 300 and 400. When air is evacuated from the compartment, the panel anti-deflection members prevent the inward flexing of the panels 300 and 400.

The second example panel anti-deflection members 2000 includes first members (not labeled) (here vertical members) and second members (not labeled) (here horizontal members) that form a grid and that are positioned between panel 300 and panel 400. Each of the members define one or more air channels (not labeled) and are suitably attached to one of the panels (here panel 300). These movement or members are equal to or slightly smaller in width than the width of the space between the panels 300 and 400. When air is evacuated from the compartment, the movement or members prevent the inward movement or flexing of the panels 300 and 400.

In various embodiments, the panel anti-deflection members are made from a non-compressible material. In various such embodiments, the non-compressible material is steel and such anti-deflection members are connected such as by welding to one of the panels 300 or 400. In alternative embodiments, the anti-deflection members can be connected to one or more of the supports or braces that define the respective compartment.

In various such embodiments, the non-compressible material is made from a non-metallic material to minimize the added weight to the boxcar from such members and avoid thermal bridging. In various embodiments, the panel anti-deflection members such as the non-compressible materials are used to avoid thermal bridging.

After the assembly of the insulated section 210, one or more suitable air evacuation devices (such as but not limited to vacuum pumps) are suitably connected to the check valves 250*a*, 250*b*, 250*c*, and 250*d* to remove air from the compartments C1 to C28. After air in the compartments is removed, the insulated section 210 will have relatively higher insulation properties because the lack of the reduced amount of air in the compartments will decrease the transfer of heat via the insulated section 210.

As mentioned above, the refrigerated boxcar can be made with a plurality of such insulated sections such as for the side walls, the doors, the end walls, the floor, and the roof.

In various embodiments, after being constructed, the entire box car (before the refrigeration unit is attached) can be heated to a desired temperature to evacuate or further evacuate air or remaining air from the compartments.

In various embodiments, after being constructed, the entire box car (before the refrigeration unit is attached) can be heated to a desired temperature during the air evacuation process to remove a greater percentage of air from the compartments. In various embodiments, the desired temperature is between 600 and 700 degrees Fahrenheit. In various such embodiments, after being constructed, the entire box car (before the refrigeration unit is attached) is heated in a large heating device such as a large oven (not shown).

In various embodiments, the heating of the insulated sections enables air in the compartments to be evacuated via the check valves, and the check valves prevent air from returning to such compartments as the insulated section cool.

It should be appreciated from the above that various embodiments of the present disclosure relate to manufacturing a boxcar and specifically a refrigerated boxcar with one or more insulated sections as described herein.

In various embodiments, the outer panel, the check valves, and the anti-defection members are the primary extra components. In other words, various embodiments of the present disclosure employ the inner panels, supports and braces of an existing boxcar construction.

It should be appreciated that quantities and positions of the supports and braces and thus the quantity and size of the compartments can vary in accordance with the present disclosure.

It will be understood that modifications and variations may be affected without departing from the scope of the novel concepts of the present invention, and it is understood that this application is to be limited only by the scope of the claims.

The invention claimed is:

1. A railroad car comprising:

a frame;

a floor supported by the frame;

a first end wall supported by the frame;

a second end wall supported by the frame;

a first side wall supported by the frame;

a second side wall supported by the frame;

a roof supported by the frame, the first end wall, the second end wall, the first side wall, and the second side wall;

one of the first side wall and the second side wall having a door that enables access to an interior area defined by the floor, the first end wall, the second end wall, the first side wall, the second side wall, and the roof; and one of the first side wall, the second side wall, the floor, the first end wall, the second end wall, and the roof including an insulated section including:

a plurality of spaced-apart supports, a plurality of spaced-apart braces fixedly connected to and extending between respective pairs of the supports, an inner panel fixedly connected to respective inner surfaces of the supports and the braces, an outer panel fixedly connected to respective outer surfaces of the supports and the braces, the inner panel and the outer panel spaced-apart based on widths of the supports and the braces, the supports, the braces, the inner panel, and the outer panel defining a series of individual air evacuation compartments, each air evacuation compartment sealed with respect to respective supports and braces that define that air evacuation compartment, a plurality of the supports each defining an air channel extending through that support to fluidly connect adjacent air evacuation compartments partially defined by that support, a plurality of the braces each defining an air channel extending through that brace to fluidly connect adjacent air evacuation compartments partially defined by that brace, and one or more check valves connected to one of the supports, each check valve configured to enable air to be evacuated from and not flow back into a plurality of the air evacuation compartments via the check valve.

2. The railroad car of claim 1, wherein one of the vertical supports does not define any air channels.

3. The railroad car of claim 1, wherein each of a plurality of the braces do not define any air channels.

4. The railroad car of claim 1, wherein each of the air evacuation compartments are in fluid communication with each of the other compartments.

5. The railroad car of claim 1, wherein a first plurality of the air evacuation compartments are in fluid communication with each other, wherein a second plurality of the air evacuation compartments are in fluid communication with each other, and wherein the first plurality of the air evacuation compartments are not in fluid communication with the second plurality of air evacuation compartments.

6. The railroad car of claim 1, which further comprises one or more panel anti-deflection members in one of the air evacuation compartments.

7. The railroad car of claim 1, which further comprises one or more panel anti-deflection members in each of a plurality of the air evacuation compartments.

8. The railroad car of claim 1, which further comprises one or more panel anti-deflection members in each of the air evacuation compartments.

9. The railroad car of claim 1, which further comprises one or more panel anti-deflection members in one of the air evacuation compartments, wherein each of the panel anti-deflection members includes a cylindrical member that is positioned between the inner panel and the outer panel and that defines one or more air channels.

10. The railroad car of claim 1, which further comprises one or more panel anti-deflection members in one of the air evacuation compartments, wherein the one or more panel anti-deflection members include a plurality of intersecting members that are positioned between the inner panel and the outer panel and that define air channels.

11. A railroad car comprising:

a frame;

a floor supported by the frame;

a first end wall supported by the frame;

a second end wall supported by the frame;

a first side wall supported by the frame;

a second side wall supported by the frame;

a roof supported by the frame, the first end wall, the second end wall, the first side wall, and the second side wall;

one of the first side wall and the second side wall having a door that enables access to an interior area defined by the floor, the first end wall, the second end wall, the first side wall, the second side wall, and the roof; and one of the first side wall and the second side wall including a first insulated section including:

a plurality of spaced-apart vertically extending supports, the supports including a first support, a last support, and a plurality of intermediate supports between the first support and the last support, a plurality of spaced-apart horizontally extending braces fixedly connected to and extending between respective pairs of the supports, an inner panel fixedly connected to respective inner surfaces of the supports and the braces, an outer panel fixedly connected to respective outer surfaces of the supports and the braces, the supports, the braces, the inner panel, and the outer panel defining a series of individual air evacuation compartments, each air evacuation compartment sealed with respect to respective supports and braces that define that air evacuation compartment, the plurality of the intermediate supports each defining an air channel extending through that support to fluidly connect horizontally adjacent air evacuation compartments partially defined by that support, a plurality of the braces each defining an air channel extending through that brace to fluidly connect vertically adjacent air evacuation compartments partially defined by that brace, and one or more check valves connected to the first support, each check valve configured to enable air to be evacuated from and not flow back into the plurality of the air evacuation compartments via the check valve.

12. The railroad car of claim 11, wherein the last vertical support does not define any air channels.

13. The railroad car of claim 11, wherein each of a plurality of lowermost braces do not define any air channels.

14. The railroad car of claim 11, wherein each of the air evacuation compartments is in fluid communication with each of the other air evacuation compartments.

15. The railroad car of claim 11, wherein a first plurality of the air evacuation compartments are in fluid communication with each other, wherein a second plurality of the air evacuation compartments are in fluid communication with each other, and wherein the first plurality of the air evacuation compartments are not in fluid communication with the second plurality of air evacuation compartments.

16. The railroad car of claim 11, which further comprises one or more panel anti-deflection members in one of the air evacuation compartments.

17. The railroad car of claim 11, which further comprises one or more panel anti-deflection members in each of a plurality of the air evacuation compartments.

18. The railroad car of claim 11, which further comprises one or more panel anti-deflection members in one of the air evacuation compartments, wherein each of the panel anti-deflection members includes a cylindrical member that is positioned between the inner panel and the outer panel and that defines one or more air channels.

19. The railroad car of claim 11, which further comprises one or more panel anti-deflection members in one of the air evacuation compartments, wherein the one or more panel anti-deflection members include a plurality of intersecting members that are positioned between the inner panel and the outer panel and that define air channels.

* * * * *